US010584917B2

(12) United States Patent
Kempfle et al.

(10) Patent No.: US 10,584,917 B2
(45) Date of Patent: Mar. 10, 2020

(54) DOMESTIC REFRIGERATION APPLIANCE HAVING AN INTERIOR LIGHTING ARRANGEMENT

(71) Applicant: BSH HAUSGERAETE GMBH, Munich (DE)

(72) Inventors: Stephan Kempfle, Ellzee (DE); Matthias Wiedenmann, Neenstetten (DE)

(73) Assignee: BSH Hausgeraete GmbH, Munich (DE)

( * ) Notice: Subject to any disclaimer, the term of this patent is extended or adjusted under 35 U.S.C. 154(b) by 139 days.

(21) Appl. No.: 15/321,829

(22) PCT Filed: Jun. 3, 2015

(86) PCT No.: PCT/EP2015/062339
§ 371 (c)(1),
(2) Date: Dec. 23, 2016

(87) PCT Pub. No.: WO2015/197327
PCT Pub. Date: Dec. 30, 2015

(65) Prior Publication Data

US 2017/0131024 A1 May 11, 2017

(30) Foreign Application Priority Data

Jun. 27, 2014 (DE) ..... 10 2014 212 438

(51) Int. Cl.
*F25D 23/00* (2006.01)
*F25D 27/00* (2006.01)
(Continued)

(52) U.S. Cl.
CPC ..... *F25D 27/00* (2013.01); *F25D 11/00* (2013.01); *F25D 23/066* (2013.01); *F25D 2400/04* (2013.01)

(58) Field of Classification Search
CPC ..... F25D 11/02; F25D 11/00; F25D 27/00; F25D 19/00; F25D 23/066; F25D 2400/04; F25C 1/00; F25C 1/24
See application file for complete search history.

(56) References Cited

U.S. PATENT DOCUMENTS 8,459,818 B2 6/2013 Becke et al.
9,010,884 B2 4/2015 Heinrich et al.
(Continued)

FOREIGN PATENT DOCUMENTS

DE 102010043546 A1 5/2012
EP 1846712 B1 6/2012
(Continued)

*Primary Examiner* — Henry T Crenshaw
*Assistant Examiner* — Kamran Tavakoldavani
(74) *Attorney, Agent, or Firm* — Laurence A. Greenberg; Werner H. Stemer; Ralph E. Locher

(57) ABSTRACT

A domestic refrigeration appliance includes a thermally insulated inner container bounding a coolable interior for food. A refrigeration device cools the interior, a door leaf opens and closes the interior, a thermally insulated wall portion has a first surface facing the interior, a second surface facing away from the interior and an opening. An interior lighting configuration at least partially illuminates the interior when the door leaf is open. The lighting configuration includes at least one lamp and a shell-like housing forming a backing part fastened on the second surface of the wall portion near a periphery of the opening and bounding a cavity which is open towards the opening. The wall portion partially overlaps the cavity forming a niche in which the at least one lamp is disposed, and the wall portion, near the niche, completely overlaps the at least one lamp.

17 Claims, 4 Drawing Sheets

(51) Int. Cl.
*F25D 23/06* (2006.01)
*F25D 11/00* (2006.01)

(56) References Cited

U.S. PATENT DOCUMENTS

| | | | | |
|---|---|---|---|---|
| 2006/0138916 | A1* | 6/2006 | Kordon | F21V 33/0044 312/223.5 |
| 2009/0056360 | A1* | 3/2009 | Krauss | F25D 27/00 62/264 |
| 2009/0133425 | A1* | 5/2009 | Goerz | F25D 17/067 62/264 |
| 2009/0277210 | A1* | 11/2009 | Eveland | F25C 5/22 62/441 |
| 2010/0220460 | A1* | 9/2010 | Hall | F25D 27/00 362/92 |
| 2012/0279247 | A1* | 11/2012 | Katu | F25C 5/22 62/344 |
| 2013/0027906 | A1 | 1/2013 | Ueda et al. | |
| 2013/0263621 | A1* | 10/2013 | An | F25C 5/185 62/344 |

FOREIGN PATENT DOCUMENTS

| | | | |
|---|---|---|---|
| EP | 2543945 | A1 | 1/2013 |
| JP | 2008075935 | A | 4/2008 |
| WO | 2010063553 | A1 | 6/2010 |

* cited by examiner

DOMESTIC REFRIGERATION APPLIANCE HAVING AN INTERIOR LIGHTING ARRANGEMENT

BACKGROUND OF THE INVENTION

Field of the Invention

The invention relates to a domestic refrigeration appliance having an interior lighting arrangement.

Domestic refrigeration appliances normally comprise an inner container which bounds a coolable interior for storing foods. The coolable interior is insulated with an insulating foam and can be closed for example by means of a door leaf. The coolable interior is accessible when the door leaf is open. Furthermore, domestic refrigeration appliances as a general rule comprise an interior lighting arrangement which is provided for example in order to at least partially illuminate the coolable interior when the door leaf is open.

WO 2010/063553 A1 discloses a domestic refrigeration appliance which has an inner container having an opening for the interior lighting arrangement. A shell of the interior lighting arrangement, in which shell an LED module is mounted, is located behind the opening on the foam side. The shell is for example made of metal or mirrored in order to exhibit a reflective surface. Reflectors are positioned in front of the LEDs.

EP 1 846 712 B1 discloses a domestic refrigeration appliance having an inner container in which a window is cut, behind which on the foam side is located a rear wall of an interior lighting arrangement. The rear wall comprises a periphery ridge which is secured by adhesive means around the window on the foam side of the inner container. The rear wall of the interior lighting arrangement comprises an inclined wall section which has a reflective coating on the inner side and is designed as a reflector.

BRIEF SUMMARY OF THE INVENTION

The object of the present invention is to specify a domestic refrigeration appliance having an improved interior lighting arrangement.

The object of the invention is achieved by a domestic refrigeration appliance having a thermally insulated inner container which bounds a coolable interior for storing foods, a refrigeration device for cooling the coolable interior, a door leaf for opening and closing the coolable interior, a thermally insulated wall portion which has a first surface facing the coolable interior, a second surface facing away from the coolable interior and an opening with a periphery, and an interior lighting arrangement in order to at least partially illuminate the coolable interior when the door leaf is open, which has at least one lamp and a shell-like housing designed in the form of a backing part which is fastened on the second surface of the wall portion in the region of the periphery of the opening, and bounds a cavity which is open in the direction of the opening, wherein the wall portion partially overlaps the cavity in order to form a niche in which the at least one lamp is arranged, and the wall portion overlaps the at least one lamp completely in the region of the niche.

The domestic refrigeration appliance according to the invention comprises the thermally insulated inner container which bounds the coolable interior. The inner container is preferably made of metal and is cooled by means of the refrigeration device. Said refrigeration device is preferably designed as a refrigerant circuit known in principle to the person skilled in the art and is preferably designed in such a manner that it cools the coolable interior at least approximately to a predetermined temperature. The coolable interior is provided for storing foods.

The inner container is thermally insulated in that the domestic refrigeration appliance preferably has a thermally-insulating insulating foam which is present in particular on the surface of the inner container facing away from the coolable interior.

The wall portion on which the interior lighting arrangement is fastened is for example part of the inner container. In this case, the surface of the inner container facing the coolable interior constitutes the first surface and the surface facing away from the coolable interior, on which surface in particular the insulating foam is present, constitutes the second surface.

The domestic refrigeration appliance comprises the door leaf which in particular is pivot-mounted relative to the inner container, preferably with respect to an axis running vertically. In the closed state the door leaf closes the coolable interior and in the opened state the coolable interior is accessible.

The domestic refrigeration appliance according to the invention furthermore comprises the interior lighting arrangement which in particular when the door leaf is open at least partially illuminates the coolable interior. The domestic refrigeration appliance according to the invention can be implemented in such a manner that the interior lighting arrangement is switched off when the door leaf is closed, in other words is switched on only when the door leaf is open. For this case the domestic refrigeration appliance according to the invention can comprise a door-ajar switch.

The domestic refrigeration appliance according to the invention is preferably a domestic cooling appliance. In this case the coolable interior is cooled to temperatures higher than 0° C. The domestic refrigeration appliance according to the invention can also be a domestic freezer appliance. In this case the coolable interior is cooled to temperatures lower than 0° C. The domestic refrigeration appliance according to the invention can however also be a refrigerator/freezer combination.

The domestic refrigeration appliance according to the invention can also be designed as a wine refrigerator which is intended for storing bottles filled with drinkable liquid, in particular wine. In this case the door leaf is preferably at least partially transparent, being made for example at least partially of glass. In particular in this case the interior lighting arrangement can also illuminate the coolable interior when the door leaf is closed.

The domestic refrigeration appliance according to the invention can also be designed as a dry-aged refrigerator. A dry-aged refrigerator is also referred to as a dry-aged cabinet and is intended for storing meat, in particular beef, in dry and cool conditions. In this case the door leaf is preferably at least partially transparent, being made for example at least partially of glass. In particular in this case the interior lighting arrangement can also illuminate the coolable interior when the door leaf is closed.

The inner container of the domestic refrigeration appliance according to the invention can in particular comprise two opposite side walls, a top and a rear wall. The inner container can also comprise a floor. If the wall portion on which the interior lighting arrangement is fastened is part of the inner container, then the interior lighting arrangement can preferably be fastened on one of the two side walls. The corresponding side wall then comprises the opening in which the interior lighting arrangement is fastened. It is however also possible that both side walls are each provided with an interior lighting arrangement. In this case both side walls each have an opening in which the corresponding interior lighting arrangement is fastened. Additionally or alternatively, the top can also be provided with a corresponding interior lighting arrangement. In this case the top has a corresponding opening for the interior lighting arrangement.

If the domestic refrigeration appliance according to the invention has a plurality of coolable interiors arranged above one another which are separated by a divider, then said divider, where applicable also a plurality of dividers, can be provided with a corresponding interior lighting arrangement. The divider comprises two wall portions, namely an upward facing wall portion which forms the floor of the upper coolable interior, and a downward facing wall portion which forms the top of the lower coolable interior. The top and/or the floor can be provided with a corresponding interior lighting arrangement.

The divider, at least one of the wall portions of the divider can be formed by the thermally insulated inner container.

According to a variant of the domestic refrigeration appliance according to the invention, said domestic refrigeration appliance can have a horizontally oriented insertable thermally insulated divider which divides the coolable interior into a first interior for storing foods and a second interior for storing foods arranged above the first interior. Said insertable thermally insulated divider is in particular designed as a slide-in unit and comprises an upward facing first wall portion and a downward facing second wall portion which bound a cavity filled with an insulating foam. The wall portion in which the interior lighting arrangement is fastened can then be part of the first or the second wall portion of the divider, in which case in particular the wall portion is made of metal. Provision can also be made that both wall portions of the divider are in each case provided with a corresponding interior lighting arrangement.

The interior lighting arrangement fastened in the side wall of the inner container preferably extends vertically and is in particular fastened on the inner container in the region of the front third of the side wall facing the door leaf, preferably in the region of the front quarter facing the door leaf.

The interior lighting arrangement fastened in the top or in the divider is in particular fastened in the region of the front third of the top or the divider facing the door leaf, preferably in the region of the front quarter facing the door leaf.

The opening for the interior lighting arrangement is preferably rectangular in form.

The interior lighting arrangement comprises at least one lamp. The at least one lamp is preferably implemented as at least one LED. By preference, the at least one lamp in question comprises a plurality of LEDs arranged next to each other. The LEDs are preferably fastened on a printed circuit board.

The interior lighting arrangement furthermore has the shell-like housing which is designed in the form of a backing part. Said housing is fastened on the second surface of the wall portion, in particular of the inner container in the region of the periphery of the opening, preferably adhesively bonded to the second surface, and forms the cavity which is open in the direction of the opening of the inner container. The shell-like housing is preferably designed as a single piece and made for example from plastic. The housing is preferably adhesively bonded extensively in the region of the periphery of the opening to the second surface of the inner container. The housing is preferably embedded in the insulating foam of the domestic refrigeration appliance.

The wall portion, preferably the inner container is furthermore designed in such a manner that it partially overlaps the cavity in order to form the niche. The at least one lamp is arranged in said niche. In addition, the wall portion or the inner container in the region of the niche is designed in such a manner that it completely overlaps the at least one lamp. As a result the wall portion, preferably the inner container obscures the at least one lamp from the direction of the coolable interior. A homogeneous illumination of the coolable interior is thereby facilitated.

According to a variant of the domestic refrigeration appliance according to the invention, the housing has a lateral wall portion which protrudes from the second surface of the wall portion and forms a part of the niche. By preference, the at least one lamp is fastened on the lateral wall portion, for example by means of at least one snap-in hook formed on the lateral wall portion. The lateral wall portion preferably forms a right angle with the second surface. The lateral wall portion runs preferably vertically and in particular faces the door leaf.

The housing can preferably have a curved wall portion which abuts against the end of the lateral wall portion facing away from the second surface and has a surface facing the coolable interior, designed as a reflector for the light produced by the at least one lamp. The curved wall portion, in particular the surface thereof designed as a reflector, likewise bounds the cavity. The surface designed as a reflector can for example be structured in order to better diffuse the light produced by the at least one lamp, for example with a rough finish. By preference, the reflector is an integral element of the curved wall portion.

The curved wall portion preferably runs from the lateral wall portion and extends as far as the region of the periphery of the opening situated opposite the lateral wall portion, in particular without the wall portion or the inner container overlapping the cavity in the region opposite the lateral wall portion.

Provision is preferably made that the at least one lamp shines its light laterally into the housing. The light is then directed by the reflector in the direction of opening into the coolable interior. It is thereby also possible to implement the interior lighting arrangement in a relatively flat fashion, for example flatter than 12 mm.

By preference, in the region of the niche the wall portion not only overlaps the at least one lamp completely, but in addition also overlaps a part of the surface of the curved wall portion, onto which the light produced by the at least one lamp falls. In particular when the plurality of LEDs arranged side by side are used as a lamp, so-called halos can form on the surface designed as a reflector in a region relatively close to the LEDs. According to the invention, said halos are obscured by the overlapping part of the wall portion and are thus no longer visible. By preference, the wall portion overlaps the cavity over a length of at least 10 mm.

In order to simplify the mounting of the interior lighting arrangement on the wall portion or the inner container, in accordance with a variant of the domestic refrigeration appliance according to the invention provision can be made that in a region of the periphery opposite the lateral wall portion the wall portion has a region designed as a lug, protruding from the second surface from the coolable interior, which engages in a slot in the housing for centering the housing, in particular in form-locked fashion. This variant is particularly advantageous if the wall portion or the inner container is made of metal. The opening can then not only be produced relatively simply for example by punching out, but the lug can also be produced relatively simply by bending the wall portion appropriately in the relevant region. The lug preferably protrudes at a right angle from the second surface.

In accordance with a further variant of the domestic refrigeration appliance according to the invention, the interior lighting arrangement has a cover which is at least semitransparent to light and is fastened on the first surface of the wall portion in the region of the periphery of the opening. The cover closes the opening and is preferably adhesively bonded to the first surface of the wall portion. Provision can be made to implement the region of the periphery of the opening to which the cover is adhesively bonded in recessed fashion. This makes it possible to prevent the surface of the cover facing in the direction of the coolable interior from projecting beyond the greater part of the surface (first surface) of the wall portion facing in the direction of the coolable interior. The cover is preferably a single piece.

The cover can preferably have an at least semitransparent region and a frame, which is impervious to light, framing said region. The opaque frame can for example be produced by printing. The semitransparent region is preferably turbid white and/or provided with a structure which refracts the light reflected from the surface of the curved wall portion designed as a reflector in order to obtain a relatively homogeneous light distribution by the interior lighting arrangement. By preference, the frame completely covers the region of the first surface on which the cover is fastened.

On the basis of the domestic refrigeration appliance according to the invention, a relatively flat LED luminaire can result as an interior lighting arrangement.

Depending on the embodiment of the domestic refrigeration appliance according to the invention, the inner container can be slightly recessed and punched out. In the housing, which preferably integrates a reflector, an LED printed circuit board, in other words a printed circuit board with LEDs, can where applicable be integrated. In this situation the LED printed circuit board is preferably situated behind the opening of the inner container. As a result a correspondingly large "mixing path" is produced for the LED light. If for example 24 LEDs arranged side by side are used, then for example said LEDs have a center-to-center spacing of 16 mm.

The optionally used cover is preferably a thin plastic plate which is preferably adhesively bonded onto the recessed inner container. The material comprising the plastic plate is preferably slightly opaque and structured and thereby enables a relatively homogeneous illumination. It may also be transparent or otherwise colored or structured. This changes the character of the interior lighting arrangement.

The cover is preferably printed on the periphery, for example in order to hide the bonding or dark area on the periphery. This printing can for example be implemented in relatively narrow fashion because the LEDs are situated further back independent of said printing. The cover can be designed as removable, for customer service purposes for example. The printed circuit board, if present, can have a snap connector contact means at the end and can be dismounted by displacement.

BRIEF DESCRIPTION OF THE SEVERAL VIEWS OF THE DRAWING

Exemplary embodiments of the invention are illustrated by way of example in the attached schematic drawings. In the drawings.

DESCRIPTION OF THE INVENTION

Figure 1:
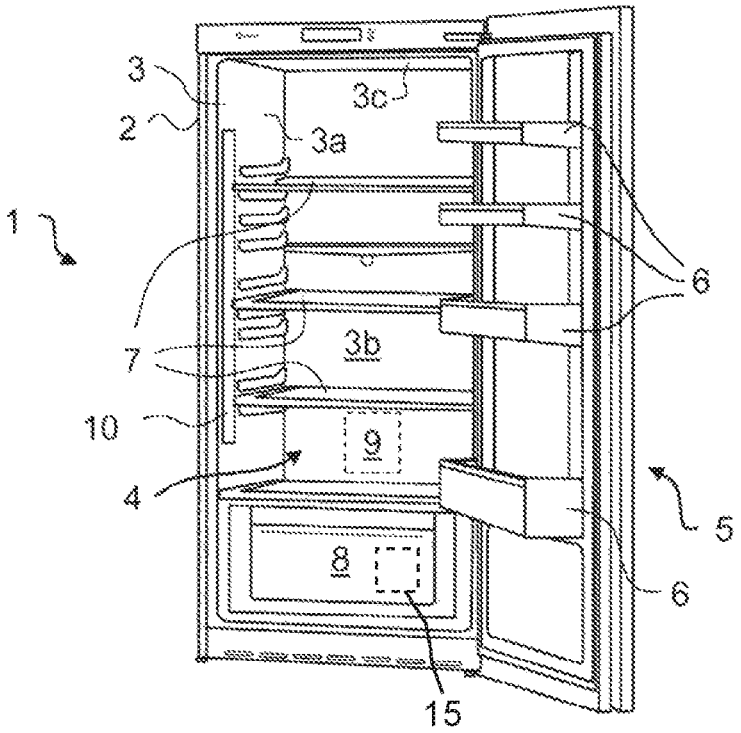
FIG. 1 shows a perspective view of a domestic refrigeration appliance having an interior lighting arrangement.

FIG. 1 shows a perspective view of a domestic refrigeration appliance 1.

The domestic refrigeration appliance 1 has a body 2 comprising a thermally insulated inner container 3 which bounds a coolable interior 4. The coolable interior 4 is intended for storing foods (not illustrated in detail). The inner container 3 comprises a plurality of walls, in particular two side walls 3*a*, a rear wall 3*b* and a top 3*c*. The inner container 3 is preferably made of metal.

In the case of the present exemplary embodiment, the domestic refrigeration appliance 1 has a pivoting door leaf 5 for closing the coolable interior 4. The door leaf 5 is in particular pivotable with respect to an axis running vertically (not illustrated). When the door leaf 5 is open, as illustrated in FIG. 1, the coolable interior 4 is accessible.

In the case of the present exemplary embodiment, a plurality of door shelves 6 for storing foods are arranged on the side of the door leaf 5 facing in the direction of the coolable interior 4. Arranged in the coolable interior 4 are in particular a plurality of compartment bases 7 for storing foods and in the lower region of the coolable interior 4 is arranged in particular a drawer 8 in which food can likewise be stored.

The domestic refrigeration appliance 1 comprises a refrigeration device 15 having a refrigerant circuit for cooling the coolable interior 4. In the case of the present exemplary embodiment, the refrigerant circuit comprises a compressor, a condenser connected downstream of the compressor, a throttling device connected downstream of the condenser, which throttling device in particular is designed as a throttle pipe or capillary tube, and an evaporator which is arranged between the throttling device and the compressor.

The domestic refrigeration appliance 1 is for example a domestic cooling appliance and/or can be designed as a so-called no-frost domestic refrigeration appliance. The domestic refrigeration appliance 1 can also be designed as a so-called wine refrigerator or as a dry-aged refrigerator. The foodstuff in question in this case is preferably bottles filled with wine or another drinkable liquid, or meat, in particular beef. The door leaf 5 is in this case preferably at least partially transparent. It is for example made at least partially of glass. In this case provision is preferably made that no door shelves 6 are arranged on the door leaf 5.

In the case of the present exemplary embodiment, the domestic refrigeration appliance 1 comprises an electronic control device 9 which is configured in order to control the refrigerant circuit, in particular the compressor thereof in a manner generally known to the person skilled in the art such that the coolable interior 4 has at least approximately a predetermined or predeterminable nominal temperature. The electronic control device 9 is preferably configured such that it regulates the temperature of the coolable interior 4. In order where appropriate to obtain the actual temperature of the coolable interior 4, the domestic refrigeration appliance 1 can have at least one temperature sensor (not illustrated in detail) which is connected to the electronic control device 9.

Figure 2:
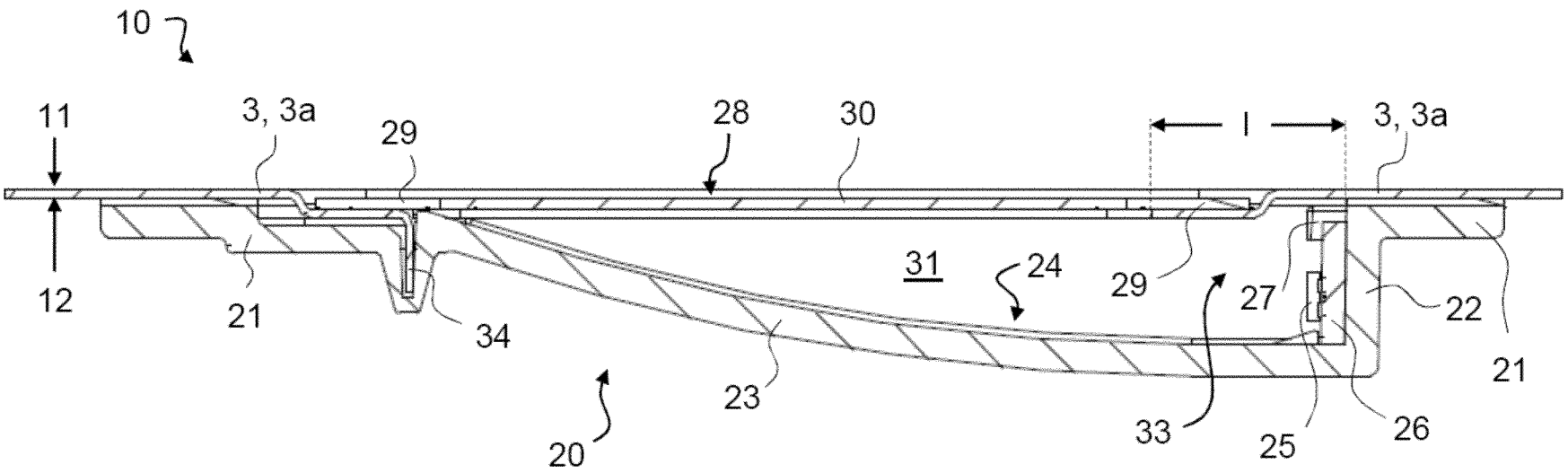
FIG. 2 shows a sectional side view of the interior lighting arrangement.

In the case of the present exemplary embodiment, the domestic refrigeration appliance 1 has at least one interior lighting arrangement 10 which in particular is configured in order to at least partially illuminate the coolable interior 4. A sectional side view of the interior lighting arrangement 10 is illustrated in FIG. 2.

The at least one interior lighting arrangement 10 is preferably designed such that it is switched on only when the door leaf 5 is open and is switched off when the door leaf 5 is closed. To this end the domestic refrigeration appliance 1 comprises for example a door-ajar switch (not shown in more detail) known in principle to the person skilled in the art, which switch can also be designed in contactless fashion. In particular in the case of the wine refrigerator or the dry-aged refrigerator the interior lighting arrangement 10 can also be in the on state with the door leaf 5 closed.

The at least one interior lighting arrangement 10 is fastened in the inner container 3, for example in one of the side walls 3*a* of the inner container 3. In particular, provision can be made that both side walls 3*a* are in each case provided with at least one interior lighting arrangement 10. Additionally or alternatively, the interior lighting arrangement 10 can be fastened in the top 3*c* of the inner container 3.

The interior lighting arrangement 10 fastened in the side wall 3*a* preferably extends vertically and is in particular fastened on the inner container 3 in the region of the front third facing the door leaf 5, preferably in the region of the front quarter of the side wall 3*a* facing the door leaf 5.

The interior lighting arrangement 10 fastened in the top 3*c* is in particular fastened on the inner container 3 in the region of the front third facing the door leaf 5, preferably in the region of the front quarter of the top 3*c* facing the door leaf 5.

The inner container 3 has a first surface 11 facing the coolable interior 4 and a second surface 12 facing away from the coolable interior 4, on which a thermal insulation implemented as an insulating foam is present. The thermal insulation is not shown explicitly but is familiar to the person skilled in the art.

Figure 3:
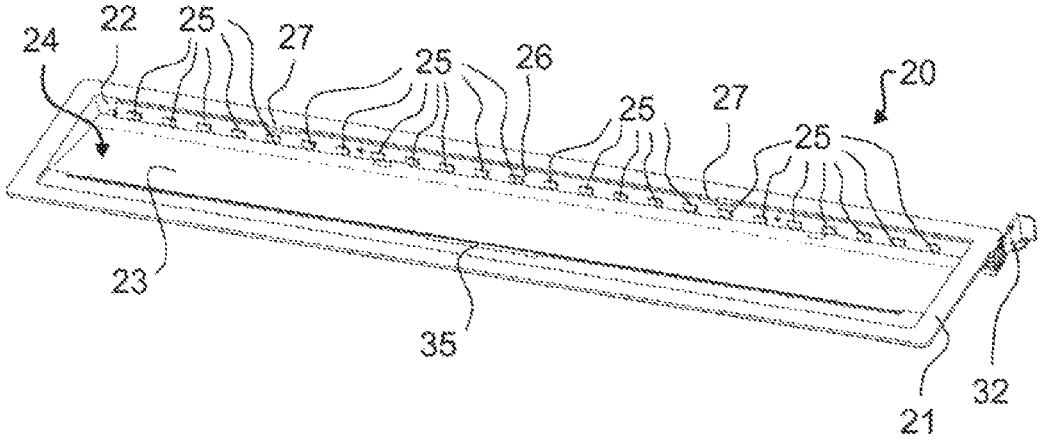
FIG. 3 shows a perspective view of an element of the interior lighting arrangement.

In the case of the present exemplary embodiment, the interior lighting arrangement 10 has a shell-like housing 20 designed in the form of a backing part, which is illustrated by a perspective view in FIG. 3. The housing 20 is preferably made of plastic and is preferably designed as a single piece. The housing 20 is intended for receiving a lamp of the interior lighting arrangement 10 and bounds a cavity 31.

Figure 4:
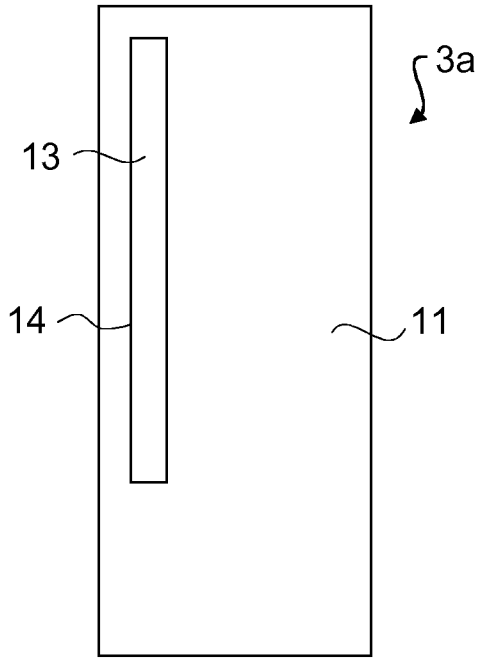
FIG. 4 shows a top view of a side wall of an inner container of the domestic refrigeration appliance.

FIG. 4 shows a top view from the direction of the coolable interior 4 of one of the two side walls 3*a*, in which the interior lighting arrangement 10 is fastened. In the inner container 3, in the case of the present exemplary embodiment, an opening 13 in which the interior lighting arrangement 10 is fastened is provided in the side wall 3*a* of the inner container 3. In the case of the present exemplary embodiment, the opening 13 thus extends vertically in the region of the front third facing the door leaf 5, preferably in the region of the front quarter of the side wall 3*a* facing the door leaf 5. The opening is in particular rectangular in form.

Figure 5:
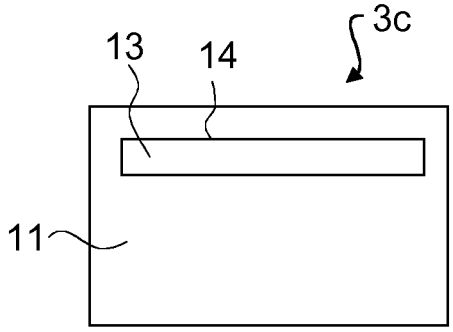
FIG. 5 shows a top view of a top of the inner container of the domestic refrigeration appliance.

FIG. 5 shows a top view from the direction of the coolable interior 4 of the top 3*c*, should the interior lighting arrangement 10 be fastened therein. The opening 13 in which the interior lighting arrangement 10 is fastened is then provided in the inner container 3 or in the top 3*c* of the inner container 3. In the case of the present exemplary embodiment, the opening 13 is thus in the region of the front third facing the door leaf 5, preferably in the region of the front quarter of the top 3*c* facing the door leaf 5. The opening is in particular rectangular in form.

The housing 20 of the interior lighting arrangement 10 is fastened in the region of the periphery 14 of the opening 13 on the second surface 12 of the inner container 3 preferably by means of an adhesive bond and is open in the direction of the opening 13. By preference, the housing 20 has a ridge 21 running circumferentially, with which the housing 20 is adhesively bonded to the second surface 12 of the inner container 3.

In the case of the present exemplary embodiment, the housing 20 of the interior lighting arrangement 10 has a lateral wall portion 22 protruding from the second surface 12 of the inner container 3, which partially bounds the cavity 31. The end of the lateral wall portion 22 facing the inner container 3 touches the second surface 12 of the inner container 3. In particular, one part of the ridge 21 abuts directly against said end of the lateral wall portion 22. The lateral wall portion 22 is for example less than 12 mm high. In particular, the housing 20 extends into the insulating foam only to a depth of less than 12 mm measured from the second surface 12 of the inner container 3. The lateral wall portion 22 is in particular vertical and faces the door leaf 5.

The housing 20 furthermore comprises a curved wall portion 23 which abuts against the end of the lateral wall portion 22 facing away from the inner container 3 and extends as far as that part of the ridge 21 which is situated opposite the lateral wall portion 22. The curved wall portion 23 is situated opposite the opening 13 and partially bounds the cavity 31.

The curved wall portion 23 has a surface 24 facing the coolable interior 4, which surface 24 serves as a reflector for the light produced by the lamp of the interior lighting arrangement 10. Said surface 24 preferably has a rough finish in order to diffuse the light.

In the case of the present exemplary embodiment, a plurality of LEDs 25 arranged side by side are provided as the lamp of the interior lighting arrangement 10, which LEDs 25 in particular are arranged on a printed circuit board 26. The LEDs 25 or the printed circuit board 26 are/is fastened on the lateral wall portion 22 such that the LEDs 25 shine their light laterally into the surface 24 of the curved wall portion 23 designed as a reflector. By preference, the LEDs 25 or the printed circuit board 26 are/is fastened on the lateral wall portion 22 by means of snap-in hooks 27 formed on the housing 20. The LEDs 25 or the printed circuit board 26 are/is for example contacted by using a snap connector 32 in order to supply the LEDs 25 with electrical energy.

On account of the surface 24 of the curved wall portion 23 designed as a reflector and shining the light from the LEDs 25 laterally into the housing 20, the light is deflected in such a manner that it also illuminates the region of the coolable interior 4 facing the rear wall 3*b* of the inner container 3 as homogeneously as possible.

In the case of the present exemplary embodiment, the interior lighting arrangement 10 has a transparent or at least semitransparent cover 28 which covers the housing 20 all the way to the coolable interior 4 or closes the opening 13. The cover 28 is preferably made of plastic. The cover 28 comprises in particular a surrounding frame 29 and an at least semitransparent region 30 bordered by the frame 29. The semitransparent region 30 is preferably turbid white and/or provided with a structure which refracts the light reflected from the surface 24 of the curved wall portion 23 designed as a reflector in order to obtain a relatively homogeneous light distribution by the interior lighting arrangement 10.

The frame 29 is preferably opaque and was produced for example by appropriate printing of the cover 28.

The cover 28 is preferably fastened on the first surface 11 of the inner container 3 facing the coolable interior 3 in a region of the periphery 14 of the opening 13 preferably by means of adhesive bonding. In the case of the present exemplary embodiment, provision is made to implement in recessed fashion the region of the periphery 14 of the opening 13 with which the cover 28 is adhesively bonded. In particular, provision is made to implement the width of the frame 29 such that the entire region of the inner container 3, which the cover 28 covers, is covered by the frame 29.

In the case of the present exemplary embodiment, provision is further made that the inner container 3 partially overlaps the cavity 31 in the region of the lateral wall portion 22 in order to form a niche 33. The lamp or the LEDs is/are thus arranged inside said niche 33. The inner container 3 overlaps the LEDs 25 completely. In particular, the inner container 3 overlaps the cavity 31 to the extent that it also overlaps a part of the curved wall portion 23 by a length l of for example at least 10 mm. This means that when viewed from the direction of the coolable interior 4 not only the lamps or the LEDs 25 are overlapped by the inner container 3 but also a part of the surface 24 of the curved wall portion 23 on which the lamp or the LEDs 25 shine their light.

In the case of the present exemplary embodiment, the inner container 3 in the region of the periphery 14 situated opposite the lateral wall portion 22 is designed such that a part of the inner container 3 is bent away from the coolable interior 3 preferably at an angle of 90°. Said part of the inner container 3 is designed as a lug 34 which engages in a slot 35 in the housing 20, in particular in form-locked fashion, for centering the housing 20 on the inner container 3.

Figure 6:
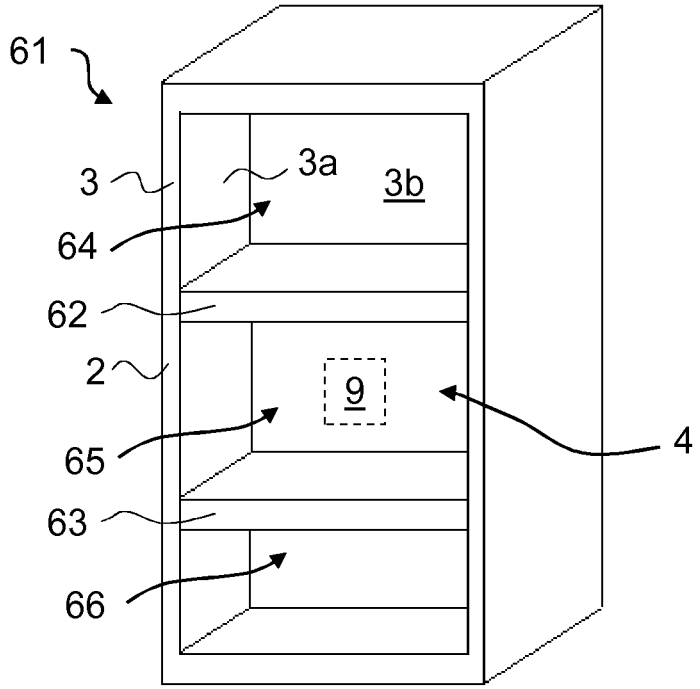
FIG. 6 shows a perspective view of a further domestic refrigeration appliance.

FIG. 6 shows a further domestic refrigeration appliance 61. Unless described otherwise, components of the domestic refrigeration appliance 61 shown in FIG. 6 which essentially have the same construction and function as components of the domestic refrigeration appliance 1 shown in FIG. 1 are then identified by the same reference characters.

The domestic refrigeration appliance 61 illustrated in FIG. 6 differs essentially from the domestic refrigeration appliance 1 illustrated in FIG. 1 in that it has at least one divider 62, 63 which divides the coolable interior 4 into a plurality of coolable interiors arranged above one another, which in particular can be cooled to different temperatures. The at least one divider 62, 63 is thermally insulated and is designed as an insertable divider.

In the case of the present exemplary embodiment, the domestic refrigeration appliance 61 has two dividers, in particular one upper divider 62 and one lower divider 63, which divide the coolable interior 4 into three interiors 64, 65, 66 arranged above one another. The two dividers 62, 63 are similar, or even identical, in the case of the present exemplary embodiment.

The domestic refrigeration appliance 61 illustrated in FIG. 6 likewise has a door leaf which is pivotable in particular with respect to an axis running vertically, but which is not illustrated in FIG. 6.

The domestic refrigeration appliance 61 illustrated in FIG. 6 likewise has the interior lighting arrangement 10 shown in FIG. 2. In this case, at least one of the side walls 3*a* can for example be provided with an interior lighting arrangement 10, or both side walls 3*a* can also each be provided with an interior lighting arrangement 10.

In the case of the present exemplary embodiment, at least one of the two dividers 62, 63 is provided with at least one of the interior lighting arrangements 10 shown in FIG. 2.

Figure 7:
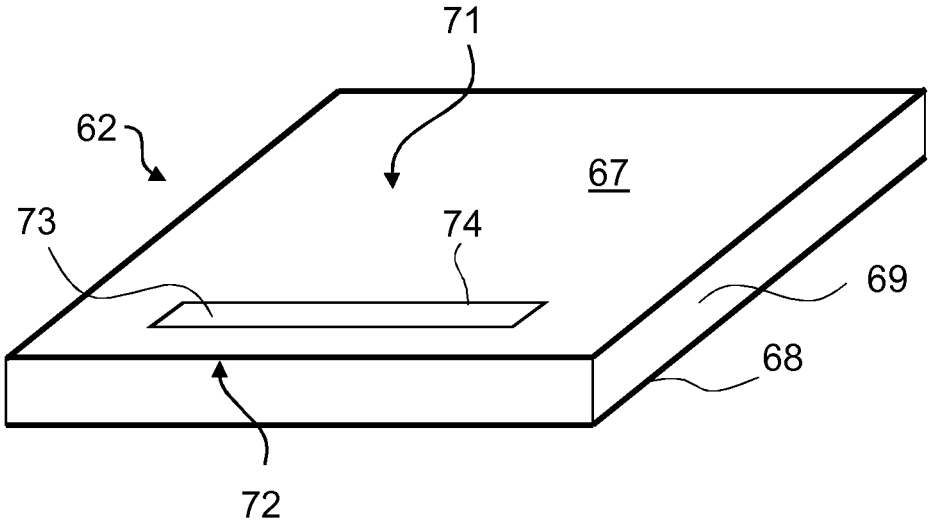
FIG. 7 shows a perspective view of a divider of the domestic refrigeration appliance shown in FIG. 6.

FIG. 7 shows a perspective view of one of the two dividers, in the case of the present exemplary embodiment the upper divider 62. The divider 62 comprises a first, upward facing wall portion 67 and a second, downward facing wall portion 68, which bound a cavity 69 filled with an insulating foam. The first wall portion 67 and the second wall portion 68 are preferably made of metal.

The first wall portion 67 has a first surface 71 facing the interior 64 arranged above the divider 62 and a second surface 72 facing away from said interior 64. The insulating foam of the divider 62 fits against the second surface 72 of the first wall portion 67. The second wall portion 68 likewise has two surfaces, a first surface of which faces the interior 65 arranged below the divider 62 and a second surface faces away from said interior. The insulating foam of the divider 62 fits against the second surface of the second wall portion 68.

In the case of the present exemplary embodiment, the interior lighting arrangement 10 is fastened on the upper divider 62. The interior lighting arrangement 10 fastened in divider 62 is in particular fastened in the region of the front third of the divider 62 facing the door leaf of the domestic refrigeration appliance 61, preferably in the region of the front quarter facing the door leaf.

In the case of the present exemplary embodiment, the interior lighting arrangement 10 is fastened in the first wall portion 67 of the divider 62. Alternatively or additionally, the second wall portion 68 of the divider can also be provided with an interior lighting arrangement 10.

The first wall portion 67 has an opening 73 with a periphery 74, which is provided similarly to the opening 13 of the domestic refrigeration appliance 1 for fastening the interior lighting arrangement 10. The housing 20 of the interior lighting arrangement 10 is thus fastened on the second surface 72 of the divider 62 in the region of the periphery 74 of the opening 73, preferably by means of an adhesive bond, and is open in the direction of the opening 73. The first wall portion 67 of the divider 62 also partially overlaps the cavity 31 in the region of the lateral wall portion 22 in order to form the niche 33 for the lamp or the LEDs 25.

LIST OF REFERENCE CHARACTERS

1 Domestic refrigeration appliance
2 Body
3 Inner container
3*a* Side walls
3*b* Rear wall
3*c* Top
4 Coolable interior
5 Door leaf
6 Door shelf
7 Compartment bases
8 Drawer
9 Electronic control device
10 Interior lighting arrangement
11, 12 Surface
13 Opening
14 Periphery
20 Housing
21 Ridge

22 Lateral wall portion
23 Curved wall portion
24 Surface
25 LEDs
26 Printed circuit board
27 Snap-in hook
28 Cover
29 Frame
30 Region
31 Cavity
32 Snap connector
33 Niche
34 Lug
35 Slot
61 Domestic refrigeration appliance
62, 62 Divider
64-66 Interior
67, 68 Wall portion
71, 72 Surface
73 Opening
74 Periphery
l Length

The invention claimed is:

1. A domestic refrigeration appliance, comprising:

a thermally insulated inner container bounding a coolable interior for storing foods;

a door leaf for opening and closing said coolable interior;

a thermally insulated wall portion of said inner container having a first surface facing said coolable interior, a second surface facing away from said coolable interior and an opening with a periphery;

an interior lighting configuration for at least partially illuminating said coolable interior when said door leaf is open, said interior lighting configuration having at least one lamp and a shell-shaped housing constructed as a backing part fastened on said second surface of said wall portion in a vicinity of said periphery of said opening and bounding a cavity being open towards said opening;

said wall portion partially overlapping said cavity to form a niche receiving said at least one lamp, said wall portion completely overlapping said at least one lamp in a vicinity of said niche;

said housing having a lateral wall portion protruding from said second surface of said wall portion and forming a part of said niche, said lateral wall portion having an end facing away from said second surface; and said housing having a curved wall portion abutting against said end of said lateral wall portion and said curved wall portion having a surface facing said coolable interior and being constructed as a reflector for light produced by said at least one lamp, said curved wall portion extending as far as a vicinity of said periphery of said opening situated opposite said lateral wall portion.

2. The domestic refrigeration appliance according to claim 1, wherein said wall portion completely overlaps said at least one lamp in a vicinity of said niche and additionally overlaps a part of said surface of said curved wall portion onto which the light produced by said at least one lamp falls.

3. The domestic refrigeration appliance according to claim 1, wherein said at least one lamp is fastened on said lateral wall portion, said curved wall portion extends as far as a vicinity of said periphery of said opening situated opposite said lateral wall portion, and said at least one lamp shines its light laterally into said housing.

4. The domestic refrigeration appliance according to claim 1, wherein said at least one lamp is fastened on said lateral wall portion.

5. The domestic refrigeration appliance according to claim 1, wherein said at least one lamp shines its light laterally into said housing.

6. The domestic refrigeration appliance according to claim 1, wherein said interior lighting configuration has a cover being at least semitransparent to light and being fastened on said first surface of said wall portion in a vicinity of said periphery of said opening.

7. The domestic refrigeration appliance according to claim 6, wherein said cover has an at least semitransparent region and a frame framing said region and being impervious to light.

8. The domestic refrigeration appliance according to claim 7, wherein said cover is fastened on a region of said first surface, and said frame completely covers said region of said first surface on which said cover is fastened.

9. The domestic refrigeration appliance according to claim 1, which further comprises:

a horizontally oriented thermally insulated divider dividing said coolable interior into a first interior for storing foods and a second interior for storing foods disposed above said first interior;

said thermally insulated divider having an upwardly facing first wall portion and a downwardly facing second wall portion bounding a cavity filled with an insulating foam; and said wall portion being part of said first or said second wall portion of said divider.

10. The domestic refrigeration appliance according to claim 9, wherein said wall portion is made of metal.

11. The domestic refrigeration appliance according to claim 1, wherein neither said wall portion nor said inner container overlaps said cavity in a region of said periphery of said opening situated opposite said lateral wall portion.

12. The domestic refrigeration appliance according to claim 1, wherein said lateral wall portion of said housing is perpendicular to said second surface of said wall portion.

13. The domestic refrigeration appliance according to claim 1, wherein said at least one lamp includes a plurality of LEDs disposed next to each other.

14. A domestic refrigeration appliance, comprising:

a thermally insulated metal inner container bounding a coolable interior for storing foods;

a door leaf for opening and closing said coolable interior;

a thermally insulated wall portion being part of said inner container and having a first surface facing said coolable interior, a second surface facing away from said coolable interior and an opening with a periphery;

an interior lighting configuration for at least partially illuminating said coolable interior when said door leaf is open, said interior lighting configuration having at least one lamp and a shell-shaped housing constructed as a backing part fastened on said second surface of said wall portion in a vicinity of said periphery of said opening and bounding a cavity being open towards said opening, said housing having a lateral wall portion with an end facing away from said second surface, said housing having a curved wall portion abutting against said end of said lateral wall portion, and said curved wall portion extending as far as a vicinity of said periphery of said opening situated opposite said lateral wall portion;

said wall portion partially overlapping said cavity to form a niche receiving said at least one lamp, said wall portion completely overlapping said at least one lamp in a vicinity of said niche; and said wall portion having a region constructed as a lug in a region of said periphery of said opening disposed opposite to said lateral wall portion, said lug protruding from said second surface facing away from said coolable inner container, and said lug engaging in a slot formed in said housing for centering said housing.

15. The domestic refrigeration appliance according to claim 14, wherein neither said wall portion nor said inner container overlaps said cavity in a region of said periphery of said opening disposed opposite said lateral wall portion.

16. The domestic refrigeration appliance according to claim 14, wherein said lateral wall portion of said housing is perpendicular to said second surface of said wall portion.

17. The domestic refrigeration appliance according to claim 14, wherein said at least one lamp includes a plurality of LEDs disposed next to each other.

* * * * *